US009230478B2

(12) United States Patent
Byeon et al.

(10) Patent No.: US 9,230,478 B2
(45) Date of Patent: Jan. 5, 2016

(54) ORGANIC LIGHT EMITTING DISPLAY DEVICE AND METHOD FOR DRIVING THE SAME

(71) Applicant: LG Display Co., Ltd., Seoul (KR)

(72) Inventors: Boeon Byeon, Gwangju (KR); Seungchan Byun, Paju-si (KR); Kyoungsik Choi, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 57 days.

(21) Appl. No.: 14/055,389

(22) Filed: Oct. 16, 2013

(65) Prior Publication Data

US 2014/0168191 A1 Jun. 19, 2014

(30) Foreign Application Priority Data

Dec. 17, 2012 (KR) ..... 10-2012-0147931

(51) Int. Cl.
*G09G 3/32* (2006.01)

(52) U.S. Cl.
CPC ..... *G09G 3/3233* (2013.01); *G09G 2300/0842* (2013.01); *G09G 2320/0295* (2013.01); *G09G 2320/048* (2013.01)

(58) Field of Classification Search
CPC ..... G09G 2320/0295; G09G 2320/48; G09G 2320/45; G09G 2320/43
USPC ..... 345/82, 531; 348/673
See application file for complete search history.

(56) References Cited

U.S. PATENT DOCUMENTS

| | | | | |
|---|---|---|---|---|
| 2004/0108982 | A1* | 6/2004 | Krohn | 345/82 |
| 2007/0236431 | A1 | 10/2007 | Tada et al. | |
| 2007/0273701 | A1* | 11/2007 | Mizukoshi et al. | 345/531 |
| 2008/0180354 | A1 | 7/2008 | Kienhoefer | |
| 2009/0147032 | A1 | 6/2009 | Kim | |
| 2010/0123699 | A1 | 5/2010 | Leon et al. | |
| 2011/0141154 | A1 | 6/2011 | Ahn et al. | |
| 2011/0141166 | A1 | 6/2011 | Ahn et al. | |
| 2011/0181787 | A1* | 7/2011 | Wang et al. | 348/673 |
| 2012/0154683 | A1 | 6/2012 | Yamashita et al. | |

FOREIGN PATENT DOCUMENTS

| | | | |
|---|---|---|---|
| CN | 101452668 | A | 6/2009 |
| CN | 102568367 | A | 7/2012 |
| DE | 102005024769 | A1 | 11/2006 |
| EP | 1310938 | A2 | 5/2003 |

(Continued)

*Primary Examiner* — Robin Mishler
*Assistant Examiner* — Kuo Woo
(74) *Attorney, Agent, or Firm* — Dentons US LLP

(57) ABSTRACT

Disclosed is an organic light emitting display device that displays images with uniform luminance by compensating degradation of organic light emitting diode, and a method for driving the same. The device comprises a display panel with sub-pixels, each sub-pixel having an organic light emitting diode for emitting light; a memory which stores accumulated data of each sub-pixel; and a panel driver which calculates an individual compensation gain value for each sub-pixel and a global compensation gain value for all the sub-pixels in common based on the accumulated data of sub-pixel, modulates input data for each sub-pixel through the individual compensation gain value and global compensation gain value, converts the modulated data into a data voltage, and accumulates the modulated data on the accumulated data of the corresponding sub-pixel and stores the obtained data in the memory.

20 Claims, 4 Drawing Sheets

(56) References Cited

FOREIGN PATENT DOCUMENTS

| | | | |
|---|---|---|---|
| JP | 2007-240804 | A | 9/2007 |
| TW | 201033973 | A | 9/2010 |
| TW | 201120864 | A | 6/2011 |
| TW | 201121337 | A | 6/2011 |

* cited by examiner

ORGANIC LIGHT EMITTING DISPLAY DEVICE AND METHOD FOR DRIVING THE SAME

CROSS REFERENCE TO RELATED APPLICATIONS

This application claims the benefit of the Korean Patent Application No. 10-2012-0147931 filed on Dec. 17, 2012, which is hereby incorporated by reference for all purposes as if fully set forth herein.

BACKGROUND OF THE INVENTION

1. Field of the Invention

Embodiments of the present invention relate to an organic light emitting display device and a method for driving the same. More particularly, the present invention relates to an organic light emitting display device to compensate degradation of an organic light emitting diode, and a method for driving the same.

2. Discussion of the Related Art

Due to recent developments in multimedia, there is an increasing demand for a flat panel display. In order to satisfy this increasing demand, various flat panel displays such as liquid crystal display device, plasma display panel, field emission display device and organic light emitting display device are practically used. Among the various flat panel displays, the organic light emitting display device drawn the attraction as a next-generation flat panel display because of its advantages of rapid response speed and low power consumption. In addition, the light emitting display is self-emitting, whereby the light emitting display does not cause a problem related with a narrow viewing angle.

Generally, the organic light emitting display device may include a display panel having a plurality of pixels, and a panel driver for driving the respective pixels so as to make the respective pixels emit light. In this case, the pixels are respectively formed in pixel regions, wherein the pixel regions are defined by crossing a plurality of gate lines and a plurality of data lines.

Referring to FIG. 1, each pixel may include a switching transistor (Tsw), a driving transistor (Tdr), a capacitor (Cst), and an organic light emitting diode (OLED).

As the switching transistor (Tsw) is switched by a gate signal (GS) supplied to a gate line (GL), a data voltage (Vdata) supplied to a data line (DL) is supplied to the driving transistor (Tdr).

As the driving transistor (Tdr) is switched by the data voltage (Vdata) supplied from the switching transistor (Tsw), it is possible to control a data current (Ioled) flowing to the organic light emitting diode (OLED) by a driving voltage (VDD).

The capacitor (Cst) is connected between gate and source terminals of the driving transistor (Tdr), wherein the capacitor (Cst) stores a voltage corresponding to the data voltage (Vdata) supplied to the gate terminal of the driving transistor (Tdr), and turns-on the driving transistor (Tdr) by the use of stored voltage.

The organic light emitting diode (OLED) is electrically connected between the source terminal of the driving transistor (Tdr) and a cathode electrode applied with a cathode voltage (VSS), wherein the organic light emitting diode (OLED) emits light by the data current (Ioled) supplied from the driving transistor (Tdr).

Each pixel of the organic light emitting display device according to the related art controls an intensity of the data current (Ioled) flowing to the organic light emitting diode (OLED) by the driving voltage (VDD) through the use of switching of the driving transistor (Tdr) according to the data voltage (Vdata), whereby the organic light emitting diode (OLED) emits light, thereby displaying an image.

FIG. 2 is a graph illustrating luminance change of the related art organic light emitting display device in accordance with the lapse of time.

As shown in FIG. 2, a degradation speed becomes faster according to the increase of driving time in the organic light emitting diode (OLED), to thereby deteriorate the luminance characteristics. In the organic light emitting display device according to the related art, it is difficult to display images with uniform luminance due to the degradation of the organic light emitting diode (OLED).

SUMMARY OF THE INVENTION

Accordingly, embodiments of the present invention are directed to an organic light emitting display device and a method for driving the same that substantially obviate one or more problems due to limitations and disadvantages of the related art.

An advantage of the present invention is to provide an organic light emitting display device that displays images with uniform luminance by compensating degradation of an organic light emitting diode, and a method for driving the same.

Additional advantages and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device that includes a display panel having a plurality of sub-pixels, wherein each sub-pixel has an organic light emitting diode which emits light by a data current based on a data voltage; a memory which stores accumulated data of each sub-pixel therein; and a panel driver which calculates an individual compensation gain value to be applied to each sub-pixel, and a global compensation gain value to be applied to all the sub-pixels in common on the basis of the accumulated data of each sub-pixel stored in the memory, modulates input data to be supplied to each sub-pixel by the use of individual compensation gain value and global compensation gain value, converts the modulated data into the data voltage, and accumulates the modulated data on the accumulated data of the corresponding sub-pixel and then stores the obtained data in the memory.

In another aspect of an embodiment of the present invention, there is provided a method for driving an organic light emitting display device with a display panel having a plurality of sub-pixels, wherein each sub-pixel has an organic light emitting diode which emits light by a data current based on a data voltage, that may include (A) calculating an individual compensation gain value to be applied to each sub-pixel, and a global compensation gain value to be applied to all the sub-pixels in common on the basis of accumulated data of the sub-pixel stored in the memory, modulating input data to be supplied to each sub-pixel by the use of individual compensation gain value and global compensation gain value, converting the modulated data into the data voltage, and accumulating the modulated data of each sub-pixel on the accumulated data of the corresponding sub-pixel and then storing the obtained data in the memory; and (B) converting the modulated data of each sub-pixel into the data voltage, and supplying the data voltage to each sub-pixel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

On explanation about the embodiments of the present invention, the following details about the terms should be understood.

The term of a singular expression should be understood to include a multiple expression as well as the singular expression if there is no specific definition in the context. If using the term such as "the first" or "the second", it is to separate any one element from other elements. Thus, a scope of claims is not limited by these terms.

Also, it should be understood that the term such as "include" or "have" does not preclude existence or possibility of one or more features, numbers, steps, operations, elements, parts or their combinations.

It should be understood that the term "at least one" includes all combinations related with any one item. For example, "at least one among a first element, a second element and a third element" may include all combinations of the two or more elements selected from the first, second and third elements as well as each element of the first, second and third elements.

Hereinafter, an organic light emitting display device according to embodiments of the present invention and a method for driving the same will be described in detail with reference to the accompanying drawings.

Figure 3:
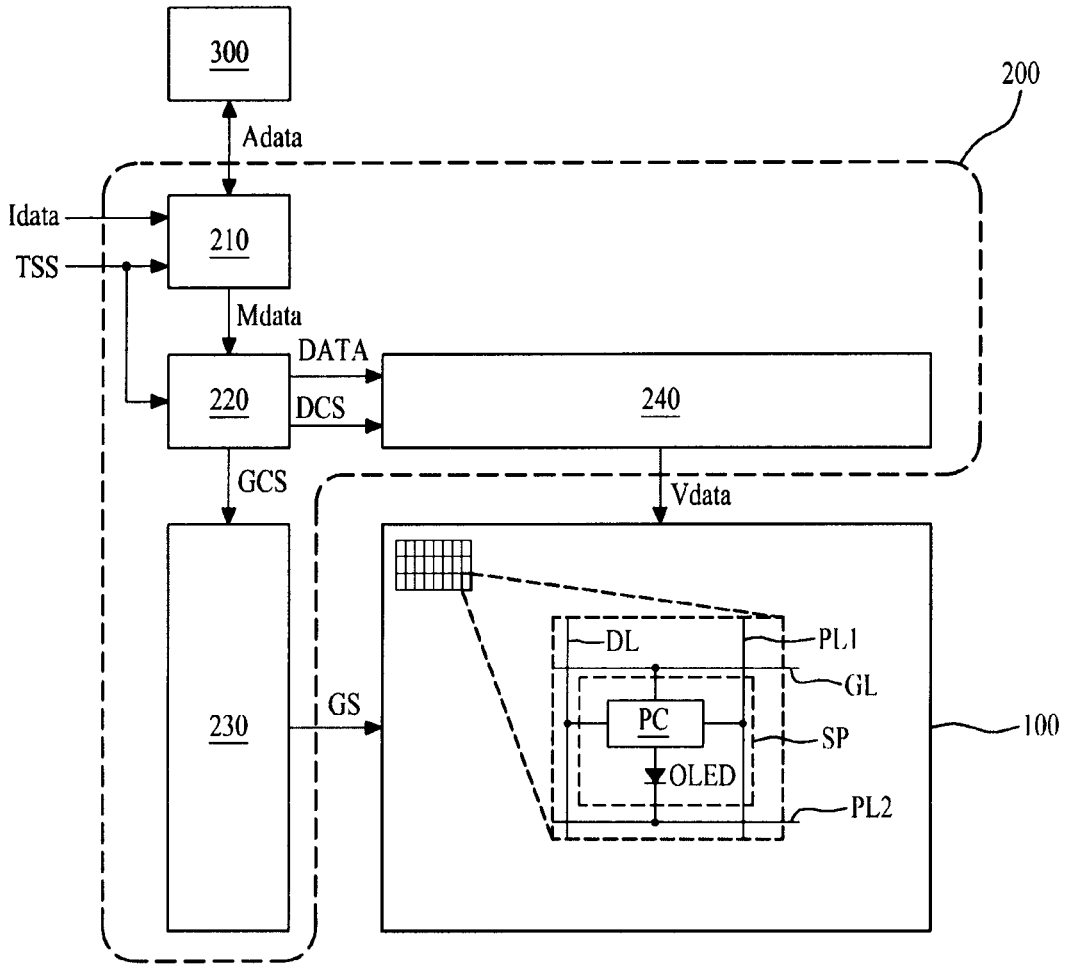
FIG. 3 illustrates an organic light emitting display device according to the embodiment of the present invention.

FIG. 3 illustrates an organic light emitting display device according to an embodiment of the present invention.

Referring to FIG. 3, the organic light emitting display device according to the embodiment of the present invention may include a display panel 100, a panel driver 200, and a memory 300.

The display panel 100 may include a plurality of sub-pixels (SP). The plurality of sub-pixels (SP) are formed in pixel regions which are defined by crossings of a plurality of gate lines (GL) and a plurality of data lines (DL). On the display panel 100, there are a plurality of driving voltage lines (PL1) which are supplied with a driving voltage from the panel driver 200, wherein the plurality of driving voltage lines (PL1) are respectively formed in parallel to the plurality of data lines (DL).

Each of the sub-pixels (SP) may be any one among red, green, blue and white sub-pixels. A unit pixel for displaying an image may comprise adjacent red, green, blue and white sub-pixels, or may comprise adjacent red, green and blue sub-pixels. Herein, supposing that a unit pixel for displaying an image comprises red, green, blue and white sub-pixels.

Each of the sub-pixels (SP) may include an organic light emitting diode (OLED) and a pixel circuit (PC).

The organic light emitting diode (OLED) is connected between the pixel circuit (PC) and a second power source line (PL2). The organic light emitting diode (OLED) emits light in proportion to an amount of data current supplied from the pixel circuit (PC), to thereby emit light with a predetermined color. To this end, the organic light emitting diode (OLED) may include an anode electrode (or pixel electrode) connected to the pixel circuit (PC), a cathode electrode (or reflective electrode) connected to the second power source line (PL2), and a light emitting cell formed between the anode electrode and the cathode electrode, wherein the light emitting cell emits any one of red-colored light, green-colored light, blue-colored light and white-colored light. In this case, the light emitting cell may be formed in a deposition structure of hole transport layer/organic light emitting layer/electron transport layer or a deposition structure of hole injection layer/hole transport layer/organic light emitting layer/electron transport layer/electron injection layer. Furthermore, the light emitting cell may include a functional layer for improving light-emitting efficiency and/or lifespan of the organic light emitting layer.

Figure 1:
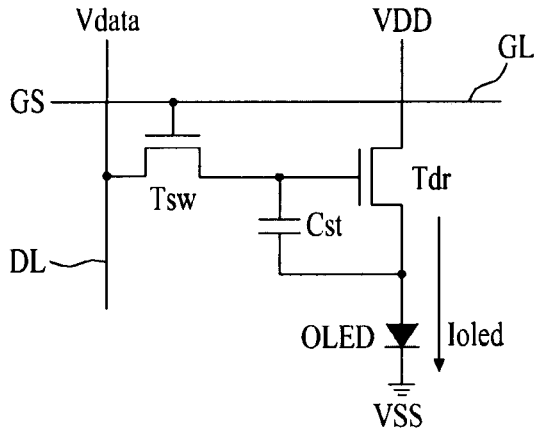
FIG. 1 Related Art
FIG. 1 illustrates a pixel structure of an organic light emitting display device according to the related art.
Figure 2:
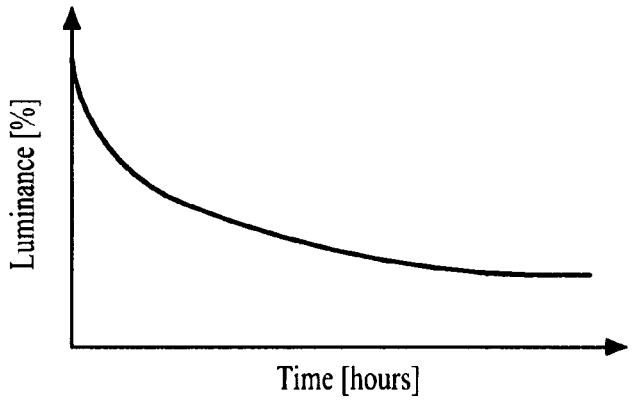
FIG. 2 Related Art
FIG. 2 is a graph illustrating a luminance change of the related art organic light emitting display device in accordance with the elapse of time.

The pixel circuit (PC) supplies the data current, which corresponds to the data voltage (Vdata) supplied from the panel driver 200 to the data line (DL) in response to a gate signal (GS) of a gate-on voltage level supplied from the panel driver 200 to the gate line (GL), to the organic light emitting diode (OLED). In this case, the data voltage (Vdata) has a voltage value obtained by compensating the degradation characteristics of the organic light emitting diode (OLED). To this end, the pixel circuit (PC) may include a switching transistor, a driving transistor and at least one capacitor, which are formed on a substrate by a process for forming a thin film transistor. The pixel circuit (PC) is identical to the related art pixel shown in FIG. 1, wherein a detailed explanation for the pixel circuit (PC) will be omitted.

The panel driver 200 modulates input data (Idata) of each sub-pixel (SP) of a current frame by calculating a global compensation gain value to be applied to all sub-pixels (SP)

in common, and an individual compensation gain value to be applied to each sub-pixel (S) based on accumulated data (Adata) of each sub-pixel (SP), which is accumulated in the memory 300 until a preceding frame prior to the current frame accumulates the modulated data (Mdata) of each sub-pixel (SP) on the accumulated data (Adata) of the corresponding sub-pixel (SP), and then stores the obtained data in the memory 300; converts the modulated data (Mdata) of each sub-pixel (SP) into the data voltage (Vdata); and supplies the data voltage (Vdata) to each sub-pixel (SP). In this case, the memory 300 stores the accumulated data of each sub-pixel (SP), which is accumulated by the panel driver 200 until the preceding frame prior to the current frame, in a unit of each sub-pixel (SP); and provides the accumulated data of each sub-pixel to the panel driver 200.

The panel driver 200 may include a degradation compensator 210, a timing controller 220, a gate driving circuit 230, and a data driving circuit 240.

The degradation compensator 210 modulates the input data (Idata) of each sub-pixel (SP) of current frame by calculating the global compensation gain value to be applied to all sub-pixels (SP) in common, and the individual compensation gain value to be applied to each sub-pixel (S) based on the accumulated data (Adata) of each sub-pixel (SP) accumulated in the memory 300; and accumulates the modulated data (Mdata) of each sub-pixel (SP) on the accumulated data (Adata) of the corresponding sub-pixel (SP), and stores the above data obtained by accumulation in the memory 300 and simultaneously provides the above data obtained by accumulation to the timing controller 220.

The timing controller 220 controls driving timing for each of the gate driving circuit 230 and the data driving circuit 240 in accordance with a timing synchronous signal (TSS) which is input from an external system body (not shown) or external graphic card (not shown). That is, the timing controller 220 generates a gate control signal (GCS) and a data control signal (DCS) on the basis of the timing synchronous signal (TSS) such as vertical synchronous signal, horizontal synchronous signal, data enable signal, dot clock, and etc., controls the driving timing of the gate driving circuit 230 by the gate control signal (GCS), and controls the driving timing of the data driving circuit 240 by the data control signal (DCS).

Also, the timing controller 220 aligns pixel data (DATA) so as to make the modulated data (Mdata) of each sub-pixel (SP), supplied from the degradation compensator 210, be appropriate for a pixel arrangement structure of the display panel 100, and then supplies the aligned pixel data (DATA) to the data driving circuit 240 on the basis of predetermined interface mode.

The timing controller 220 may include the degradation compensator 210 therein. In this case, the degradation compensator 210 may be provided inside the timing controller 220, wherein the degradation compensator 210 may be provided in a program or logic type.

The gate driving circuit 230 generates the gate signal (GS) corresponding to an image-displaying order on the basis of gate control signal (GCS) supplied from the timing controller 220, and then supplies the generated gate signal (GS) to the corresponding gate line (GL). The gate driving circuit 230 may be formed of a plurality of integrated circuits (IC), or may be directly formed on the display panel 100 during a process for forming the transistor for each sub-pixel (SP), and connected with one side or both sides in each of the plurality of gate lines (GL).

The data driving circuit 240 is supplied with the pixel data (DATA) and the data control signal (DCS) from the timing controller 220, and is also supplied with a plurality of reference gamma voltages from an external reference gamma voltage supplier (not shown). The data driving circuit 240 converts the pixel data (DATA) into the analog-type data voltage (Vdata) by the plurality of reference gamma voltages in accordance with the data control signal (DCS), and then supplies the data voltage (Vdata) to the data line (DL) of the corresponding sub-pixel (SP). The data driving circuit 240 may be formed of a plurality of integrated circuits (IC), and connected with one side or both sides in each of the plurality of data lines (DL).

Figure 4:
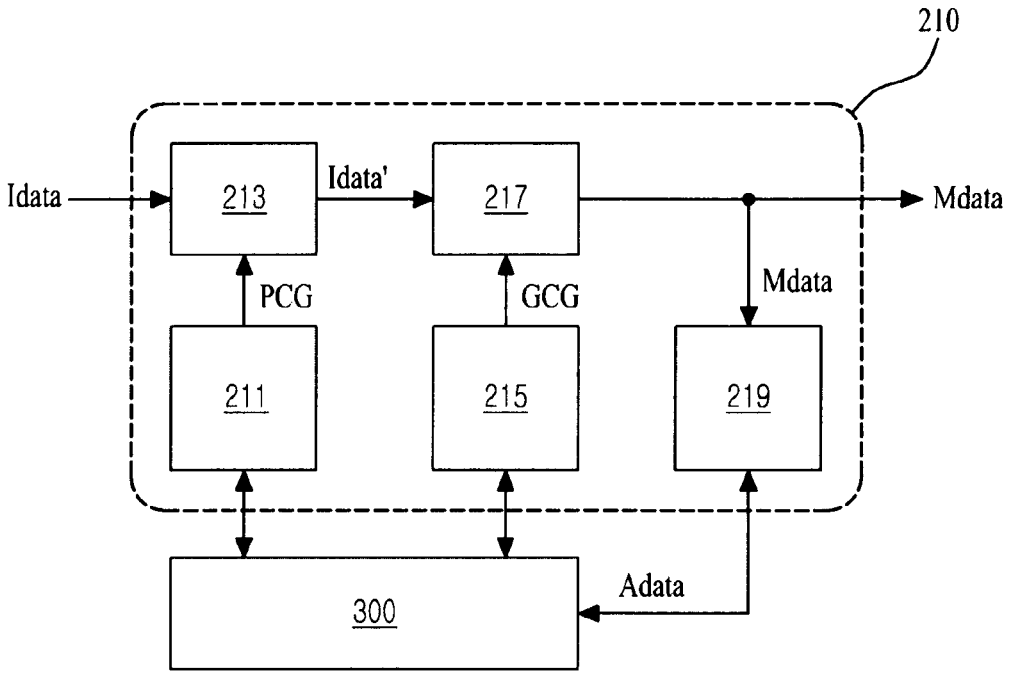
FIG. 4 is a block diagram illustrating a degradation compensator shown in FIG. 3 according to the first embodiment of the present invention.

FIG. 4 is a block diagram illustrating the degradation compensator, shown in FIG. 3, according to the first embodiment of the present invention.

Referring to FIG. 4, the degradation compensator 210 according to the first embodiment of the present invention may include an individual compensation gain value calculator 211, an individual compensator 213, a global compensation gain value calculator 215, a global compensator 217, and a data accumulator 219.

The individual compensation gain value calculator 211 calculates the individual compensation gain value (PCG) of each sub-pixel (SP) based on the accumulated data of the respective sub-pixels (SP) stored in the memory 300. In this case, the individual compensation gain value calculator 211 calculates the individual compensation gain value (PCG) to increase a luminance of the organic light emitting diode (OLED) degraded in accordance with the elapse of driving time of each sub-pixel (SP) to a preset target luminance (or initial luminance). For example, the individual compensation gain value calculator 211 predicts a degradation level of the organic light emitting diode (OLED) of the corresponding sub-pixel (SP) in accordance with the accumulated data of the corresponding sub-pixel (SP); and calculates the individual compensation gain value (PCG) to increase the luminance of the corresponding sub-pixel (SP) to the preset target luminance (or initial luminance) on the basis of the predicted degradation level. In this case, the individual compensation gain value (PCG) may be a real number which is not less than 1.

The individual compensator 213 generates input correction data (Idata') by correcting the input data (Idata) of each sub-pixel (SP), which is input from the external system body (not shown) or graphic card (not shown), on the basis of the individual compensation gain value (PCG) of each sub-pixel (SP) supplied from the individual compensation gain value calculator 211. For example, the individual compensator 213 may generate the input correction data (Idata') by multiplying the input data (Idata) and the corresponding individual compensation gain value (PCG), but not limited to this method. That is, the input correction data (Idata') may be generated by any one of the four fundamental arithmetic operations such as addition, subtraction, multiplication and division.

The global compensation gain value calculator 215 calculates the global compensation gain value (GCG) to be applied to all the sub-pixels (SP) in common on the basis of the accumulated data of the sub-pixels (SP) stored in the memory 300. In this case, the global compensation gain value (GCG) may be a real number between 0 and 1.

Preferably, the global compensation gain value calculator 215 calculates the maximum accumulated data having the maximum value from the accumulated data of all the sub-pixels, and calculates the global compensation gain value (GCG) in accordance with the maximum accumulated data. If the global compensation gain value (GCG) is applied to the input correction data (Idata'), it is possible to delay the degradation speed of the organic light emitting diode (OLED) included in the sub-pixel having the maximum accumulated data.

According to a modulated example, the global compensation gain value calculator 215 may calculate mean accumulated data by adding the accumulated data of all the sub-pixels (SP), and may calculate the global compensation gain value (GCG) in accordance with the mean accumulated data.

According to another modulated example, the global compensation gain value calculator 215 may calculate the minimum accumulated data having the minimum value from the accumulated data of all the sub-pixels (SP), and may calculate the global compensation gain value (GCG) in accordance with the minimum accumulated data.

The global compensator 217 modulates the input correction data (Idata') of each sub-pixel (SP) supplied from the individual compensator 213 on the basis of the global compensation gain value (GCG) supplied from the global compensation gain value calculator 215, and supplies the modulated data (Mdata) of each sub-pixel (SP) to the aforementioned timing controller 220. For example, the global compensator 217 may generate the modulated data (Mdata) by multiplying the input correction data (Idata') of each sub-pixel (SP) and the global compensation gain value (GCG), but not limited to this method. The modulated data (Mdata) may be generated by any one of the four fundamental arithmetic operations such as addition, subtraction, multiplication and division.

The data accumulator 219 reads the accumulated data of each sub-pixel (SP) stored in the memory 300; accumulates and adds the modulated data (Mdata) of the corresponding sub-pixel (SP) outputted from the global compensator 217 on the read accumulated data of the sub-pixel (SP); and stores the accumulated data (Adata) of each sub-pixel (SP) accumulated until to the current frame in the memory 300. Accordingly, the accumulated data (Adata) of each sub-pixel (SP) stored in the memory 300 is used as reference data for modulating each sub-pixel (SP) of the next frame.

Figure 5:
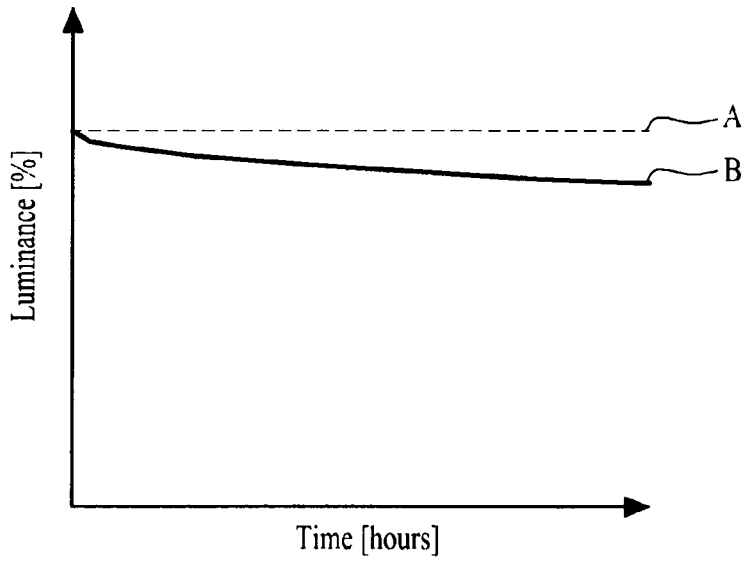
FIG. 5 is a graph illustrating luminance changes in organic light emitting diodes of the first embodiment and the first comparative example in accordance with the driving time (hours)

FIG. 5 is a graph illustrating luminance changes in the organic light emitting diodes of the first embodiment and the first comparative example in accordance with the driving time (hours).

First, as shown in FIG. 5, 'A' graph shows luminance change in accordance with the driving time of the sub-pixel in the first comparative example which applies the aforementioned individual compensation gain value, and 'B' graph shows luminance change in the accordance with the driving time of the sub-pixel in the first embodiment which applies both the aforementioned individual compensation gain value and the global compensation gain value.

As shown in 'A' graph of FIG. 5, the first comparative example applies only the individual compensation gain value (PCG) so as to increase the luminance of the degraded organic light emitting diode to the preset target luminance (or initial luminance), thereby realizing the uniform luminance of the image displayed on the display panel 100. However, in case of the first comparative example, the degradation of the degraded organic light emitting diode may be accelerated due to the application of the individual compensation gain value (PCG), and thus the lifespan of the organic light emitting diode may be shortened.

Meanwhile, as shown in 'B' graph of FIG. 5, the first embodiment of the present invention applies both the individual compensation gain value (PCG) and the global compensation gain value (GCG), whereby the luminance of all the sub-pixels (SP) applied with the individual compensation gain value (PCG) is simultaneously decreased in correspondence to the global compensation gain value (GCG). Thus, in comparison to the first comparative example, the first embodiment of the present invention enables to decrease the degradation speed, and thus to increase the lifespan of the organic light emitting diode.

Accordingly, the reason why the degradation compensator 210 according to the first embodiment of the present invention is included is to display the image with the uniform luminance by calculating the individual compensation gain value (PCG) to be individually applied to each of the sub-pixels (SP) and the global compensation gain value (GCG) to be applied to all the sub-pixels (SP) in common, and modulating the input data (Idata) of each sub-pixel (SP) of the current frame so as to compensate the degradation of the organic light emitting diode of each sub-pixel (SP) through the application of the individual compensation gain value (PCG); and to increase the lifespan of the organic light emitting diode by simultaneously lowering the luminance of all the sub-pixels (SP) through the global compensation gain value (GCG) so as to decrease the degradation speed of the organic light emitting diode occurring in the application of the individual compensation gain value (PCG).

Figure 6:
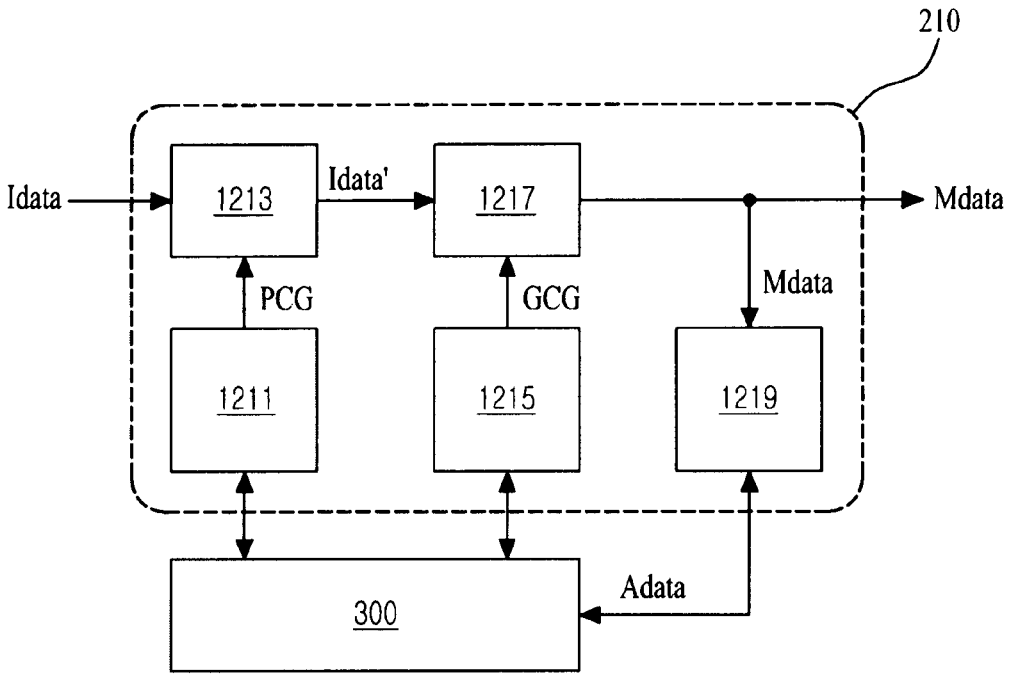
FIG. 6 is a block diagram illustrating a degradation compensator shown in FIG. 3 according to the second embodiment of the present invention.

FIG. 6 is a block diagram illustrating the degradation compensator shown in FIG. 3 according to the second embodiment of the present invention.

Referring to FIG. 6, the degradation compensator 210 according to the second embodiment of the present invention may include an individual compensation gain value calculator 1211, an individual compensator 1213, a global compensation gain value calculator 1215, a global compensator 1217, and a data accumulator 1219.

The individual compensation gain value calculator 1211 calculates the individual compensation gain value (PCG) of each sub-pixel (SP) based on the accumulated data of each sub-pixel (SP) stored in the memory 300. In this case, the individual compensation gain value calculator 1211 calculates the individual compensation gain value (PCG) to decrease a luminance of the organic light emitting diode (OLED) degraded in accordance with the elapse of driving time of each sub-pixel (SP) to a luminance of the organic light emitting diode (OLED) which is the most degraded. For example, the individual compensation gain value calculator 1211 extracts the maximum accumulated data with the maximum value from the accumulated data of all the sub-pixels (SP) stored in the memory 300; calculates the difference value between the extracted maximum accumulated data and the accumulated data of each sub-pixel (SP); and calculates the individual compensation gain value (PCG) of each sub-pixel (SP) on the basis of the calculated difference value. In this case, the individual compensation gain value (PCG) may be a real number between 0 and 1.

The individual compensator 1213 generates the input correction data (Idata') by correcting the input data (Idata) of each sub-pixel (SP), which is input from the external system body (not shown) or graphic card (not shown), on the basis of the individual compensation gain value (PCG) of each sub-pixel (SP) supplied from the individual compensation gain value calculator 1211. For example, the individual compensator 1213 may generate the input correction data (Idata') by multiplying the input data (Idata) and the corresponding individual compensation gain value (PCG), but not limited to this method. That is, the input correction data (Idata') may be generated by any one of the four fundamental arithmetic operations such as addition, subtraction, multiplication and division.

The global compensation gain value calculator 1215 calculates the global compensation gain value (GCG) to be applied to all the sub-pixels (SP) in common on the basis of the accumulated data of all the sub-pixels (SP) stored in the memory 300. In this case, the global compensation gain value (GCG) may be a real number which is not less than 1.

Preferably, the global compensation gain value calculator 1215 calculates the minimum accumulated data having the minimum value from the accumulated data of all the sub-pixels (SP), and calculates the global compensation gain value (GCG) in accordance with the minimum accumulated data. If the global compensation gain value (GCG) is applied to the input correction data (Idata'), it is possible to increase the luminance of the other sub-pixels with respect to the luminance of the sub-pixel having the minimum accumulated data, thereby increasing the luminance of the image.

According to a modulated example, the global compensation gain value calculator 1215 may calculate mean accumulated data by adding up the accumulated data of all the sub-pixels (SP), and may calculate the global compensation gain value (GCG) in accordance with the mean accumulated data.

According to another modulated example, the global compensation gain value calculator 1215 may calculate the maximum accumulated data having the maximum value from the accumulated data of all the sub-pixels (SP), and may calculate the global compensation gain value (GCG) in accordance with the maximum accumulated data.

The global compensator 1217 modulates the input correction data (Idata') of each sub-pixel (SP) supplied from the individual compensator 1213 on the basis of the global compensation gain value (GCG) supplied from the global compensation gain value calculator 1215, and supplies the modulated data (Mdata) of each sub-pixel (SP) to the aforementioned timing controller 220. For example, the global compensator 1217 may generate the modulated data (Mdata) by multiplying the input correction data (Idata') of each sub-pixel (SP) and the global compensation gain value (GCG), but not limited to this method. The modulated data (Mdata) may be generated by any one of the four fundamental arithmetic operations such as addition, subtraction, multiplication and division.

The data accumulator 1219 reads the accumulated data of each sub-pixel (SP) stored in the memory 300; accumulates and adds the modulated data (Mdata) of the corresponding sub-pixel (SP) outputted from the global compensator 1217 on the read accumulated data of the sub-pixel (SP); and stores the accumulated data (Adata) of each sub-pixel (SP) accumulated until to the current frame in the memory 300. Accordingly, the accumulated data (Adata) of each sub-pixel (SP) stored in the memory 300 is used as reference data for modulating each sub-pixel (SP) of the next frame.

Figure 7:
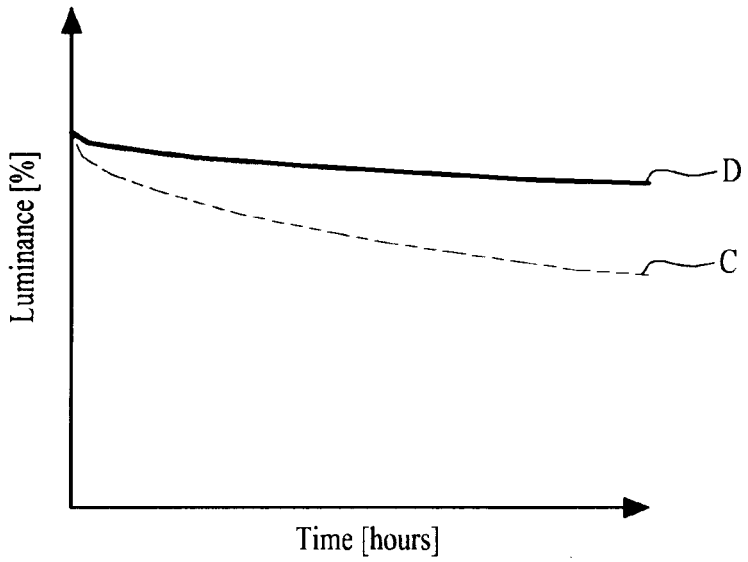
FIG. 7 is a graph illustrating luminance changes in organic light emitting diodes of the second embodiment and the second comparative example in accordance with the driving time (hours).

FIG. 7 is a graph illustrating luminance changes in the organic light emitting diodes of the second embodiment and the second comparative example in accordance with the driving time (hours).

First, as shown in FIG. 7, 'C' graph shows luminance change in accordance with the driving time of the sub-pixel in the second comparative example which applies the aforementioned individual compensation gain value, and 'D' graph shows luminance change in the accordance with the driving time of the sub-pixel in the second embodiment which applies both the aforementioned individual compensation gain value and the global compensation gain value.

As shown in 'C' graph of FIG. 7, the second comparative example applies only the individual compensation gain value (PCG) so as to decrease the luminance of the degraded organic light emitting diode to the luminance of the organic light emitting diode (OLED) which is the most degraded, to thereby realize the uniform luminance of the image displayed on the display panel 100. However, in case of the second comparative example, the luminance of the display panel 100 is gradually decreased in accordance with the driving time of the sub-pixel (SP) through the application of the individual compensation gain value (PCG), and the lifespan of the organic light emitting display device is shortened.

Meanwhile, as shown in 'D' graph of FIG. 7, the second embodiment of the present invention applies both the individual compensation gain value (PCG) and the global compensation gain value (GCG), whereby the luminance of all the sub-pixels (SP) applied with the individual compensation gain value (PCG) is simultaneously increased in correspondence to the global compensation gain value (GCG). Thus, in comparison to the second comparative example, the second embodiment of the present invention enables to decrease the luminance of the display panel 100 in accordance with the driving time of the sub-pixel (SP), and thus to increase the lifespan of the organic light emitting diode.

Accordingly, the reason why the degradation compensator 210 according to the second embodiment of the present invention is included is to display the image with the uniform luminance by calculating the individual compensation gain value (PCG) to be individually applied to each of the sub-pixels (SP) and the global compensation gain value (GCG) to be applied to all the sub-pixels (SP) in common, and modulating the input data (Idata) of each sub-pixel (SP) of the current frame so as to compensate the degradation of the organic light emitting diode of each sub-pixel (SP) through the application of the individual compensation gain value (PCG); and to increase the lifespan of the organic light emitting diode by simultaneously increasing the luminance of all the sub-pixels (SP) through the global compensation gain value (GCG) so as to decrease the degradation speed of the organic light emitting diode occurring in the application of the individual compensation gain value (PCG).

According to the present invention, the organic light emitting display device according to the present invention and the method for driving the same facilitate to display the image with the uniform luminance by modulating the data to be supplied to each sub-pixel (SP) through the use of the global compensation gain value (CGC) and the individual compensation gain value (PCG) calculated based on the accumulated data of each sub-pixel (SP), and compensating the degradation of the organic light emitting diode of each sub-pixel (SP) through the application of the individual compensation gain value, and also to increase the lifespan of the organic light emitting display device by decreasing the degradation speed and adjusting the luminance of all the sub-pixels through the application of the global compensation gain value (GCG).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel having a plurality of sub-pixels, wherein each sub-pixel includes an organic light emitting diode which emits light by a data current based on a data voltage;

a memory which stores accumulated data of each sub-pixel therein; and a panel driver which calculates an individual compensation gain value to be applied to each sub-pixel, and a global compensation gain value to be applied to all the sub-pixels in common on a basis of the accumulated data of each sub-pixel stored in the memory, generates input correction data of each sub-pixel by individually correcting input data of each sub-pixel to be supplied to each sub-pixel by the use of the individual compensation gain value, generates modulated data of each sub-pixel by modulating the input correction data of each sub-pixel in common by the use of the global compensation gain value, converts the modulated data into the data voltage, and accumulates the modulated data on the accumulated data of the corresponding sub-pixel from a current frame and then stores obtained data in the memory to be used as accumulated data for modulating each sub-pixel in a next frame.

2. The device of claim 1, wherein the panel driver comprises a degradation compensator, wherein the degradation compensator includes:

an individual compensation gain value calculator which calculates the individual compensation gain value of each sub-pixel on the basis of the accumulated data of each sub-pixel stored in the memory;

an individual compensator which generates the input correction data of each sub-pixel by correcting the input data of each sub-pixel in accordance with the individual compensation gain value of each sub-pixel;

a global compensation gain value calculator which calculates the global compensation gain value on the basis of the accumulated data of each sub-pixel stored in the memory;

a global compensator which generates the modulated data of each sub-pixel by modulating the input correction data of each sub-pixel in accordance with the global compensation gain value; and a data accumulator which accumulates the modulated data of each sub-pixel on the accumulated data of the corresponding sub-pixel, and stores the obtained data in the memory.

3. The device of claim 2, wherein the individual compensation gain value calculator calculates the individual compensation gain value for increasing a luminance of each sub-pixel on the basis of the accumulated data of each sub-pixel.

4. The device of claim 3, wherein the individual compensation gain value is set to a real number which is not less than 1.

5. The device of claim 3, wherein the global compensation gain value calculator calculates the global compensation gain value on the basis of the accumulated data of any one of maximum accumulated data, average accumulated data, and minimum accumulated data from the accumulated data of all the sub-pixels.

6. The device of claim 5, wherein the global compensation gain value is set to a real number between 0 and 1.

7. The device of claim 2, wherein the individual compensation gain value calculator calculates the individual compensation gain value for decreasing a luminance of each sub-pixel on the basis of the accumulated data of the sub-pixel.

8. The device of claim 7, wherein the individual compensation gain value is set to a real number between 0 and 1.

9. The device of claim 7, wherein the global compensation gain value calculator calculates the global compensation gain value on the basis of the accumulated data of any one of minimum accumulated data, average accumulated data, and maximum accumulated data from the accumulated data of all the sub-pixels.

10. The device of claim 9, wherein the global compensation gain value is set to a real number which is not less than 1.

11. A method for driving an organic light emitting display device with a display panel having a plurality of sub-pixels, wherein each sub-pixel has an organic light emitting diode which emits light by a data current based on a data voltage, comprising:

(A) calculating an individual compensation gain value to be applied to each sub-pixel, and a global compensation gain value to be applied to all the sub-pixels in common on a basis of accumulated data of the sub-pixel stored in the memory, generating input correction data of each sub-pixel by individually correcting input data of each sub-pixel to be supplied to each sub-pixel by the use of the individual compensation gain value, generating modulated data of each sub-pixel by modulating the input correction data of each sub-pixel in common by the use of the global compensation gain value, converting the modulated data into the data voltage, and accumulating the modulated data of each sub-pixel on the accumulated data of the corresponding sub-pixel from a current frame and then storing obtained data in the memory to be used as accumulated data for modulating each sub-pixel in a next frame; and (B) converting the modulated data of each sub-pixel into the data voltage, and supplying the data voltage to each sub-pixel.

12. The method of claim 11, wherein the step (A) comprises:

calculating the individual compensation gain value of each sub-pixel on the basis of the accumulated data of each sub-pixel stored in the memory;

generating the input correction data of each sub-pixel by correcting the input data of each sub-pixel in accordance with the individual compensation gain value of each sub-pixel;

calculating the global compensation gain value on the basis of the accumulated data of each sub-pixel stored in the memory;

generating the modulated data of each sub-pixel by modulating the input correction data of each sub-pixel in accordance with the global compensation gain value; and accumulating the modulated data of each sub-pixel on the accumulated data of the corresponding sub-pixel, and storing the obtained data in the memory.

13. The method of claim 12, wherein the step of calculating the individual compensation gain value is to calculate the individual compensation gain value for increasing a luminance of each sub-pixel on the basis of the accumulated data of the sub-pixel.

14. The method of claim 13, wherein the individual compensation gain value is set to a real number which is not less than 1.

15. The method of claim 13, wherein the step of calculating the global compensation gain value is to calculate the global compensation gain value on the basis of the accumulated data of any one of maximum accumulated data, average accumulated data, and minimum accumulated data from the accumulated data of all the sub-pixels.

16. The method of claim 15, wherein the global compensation gain value is set to a real number between 0 and 1.

17. The method of claim 12, wherein the step of calculating the individual compensation gain value is to calculate the individual compensation gain value for decreasing a luminance of each sub-pixel on the basis of the accumulated data of the sub-pixel.

18. The method of claim 17, wherein the individual compensation gain value is set to a real number between 0 and 1.

19. The method of claim 17, wherein the step of calculating the global compensation gain value is to calculate the global compensation gain value on the basis of the accumulated data of any one of minimum accumulated data, average accumulated data, and maximum accumulated data from the accumulated data of all the sub-pixels.

20. The method of claim 19, wherein the global compensation gain value is set to a real number which is not less than 1.

* * * * *